United States Patent [19]

Moomaw et al.

[11] Patent Number: 4,793,610

[45] Date of Patent: Dec. 27, 1988

[54] TOY AIRPLANE AMUSEMENT GAME

[75] Inventors: David E. Moomaw, East Aurora; Frederick B. Robjent, Orchard Park, both of N.Y.

[73] Assignee: The Quaker Oats Company, Chicago, Ill.

[21] Appl. No.: 101,986

[22] Filed: Sep. 29, 1987

[51] Int. Cl.[4] ..... A63F 9/06

[52] U.S. Cl. ..... 273/1 GC; 434/32; 446/7; 273/366

[58] Field of Search ..... 273/1 G A, 1 G B, 9 C, 273/9 E, 359, 366, 367; 446/7; 434/32

[56] References Cited

U.S. PATENT DOCUMENTS 3,171,215 3/1965 Glass et al. ..... 273/1 GA X
4,212,459 7/1980 Wolf ..... 273/1 GA
4,231,571 11/1980 Watanabe ..... 273/1 GA
4,269,596 5/1981 D'Andrade ..... 434/32

*Primary Examiner*—Paul E. Shapiro
*Attorney, Agent, or Firm*—Cumpston & Shaw

[57] ABSTRACT

A toy airplane amusement game has a plurality of flip-up targets which are randomly laterally and longitudinally spaced on a web, and are transported past a miniature airplane facing the oncoming targets. The airplane is provided with manual controls for moving the airplane laterally and vertically across the web and into the paths of the successively oncoming targets for knocking them down. The controls include a linkage to allow the operator to align the airplane parallel to the path of travel of the oncoming targets in any selected position across the width of the web.

8 Claims, 4 Drawing Sheets

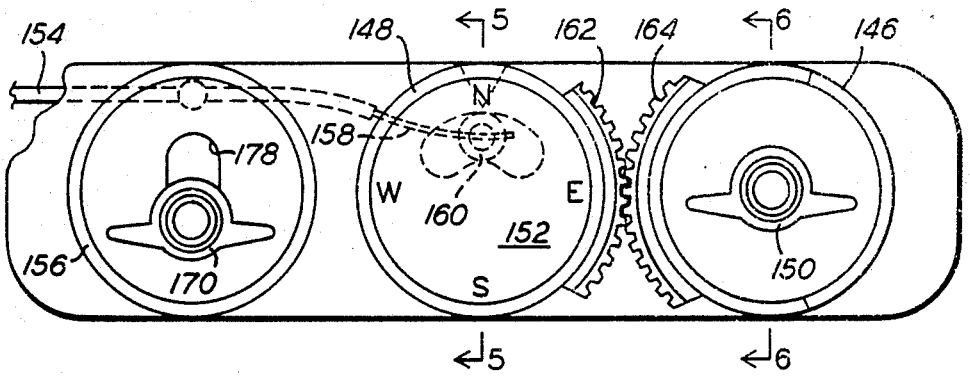
FIG. 4
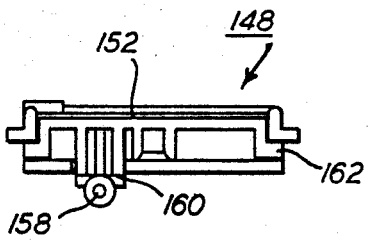
FIG. 5
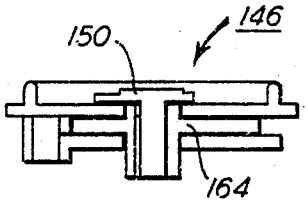
FIG. 6
FIG. 7
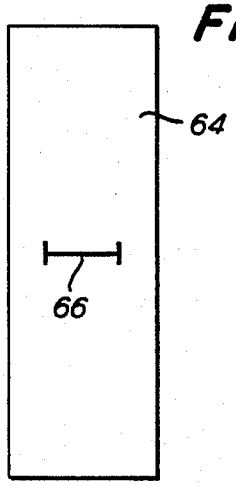
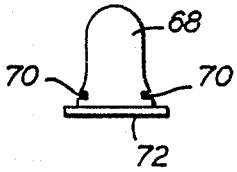
FIG. 8
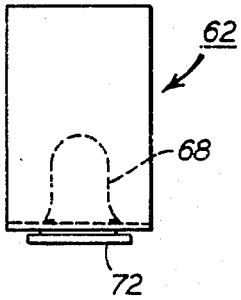
FIG. 9

TOY AIRPLANE AMUSEMENT GAME

FIELD OF THE INVENTION

The present invention relates generally to toys, and more specifically to a toy airplane amusement game including a maneuverable airplane for knocking down oncoming flip-up targets.

BACKGROUND OF THE INVENTION:

A great variety of relatively complicated and expensive electronic amusement games are presently available in amusement parks or the like for indulging youths and adults. A great need has existed for some time and still exists to provide amusement games for young children that simulate the amusement games enjoyed by the older population. Accordingly, an object of the present invention is to provide a toy amusement game for young children that in addition to being safe and interesting to children is of simple design and construction, thoroughly reliable in operation, and economical to manufacture.

SUMMARY OF THE INVENTION

An object of this invention is accomplished by providing a toy airplane amusement game for knocking down oncoming flip-up targets comprising:

means for transporting a web of a finite width containing laterally and longitudinally spaced targets;

means for flipping the targets from a non-vertical position to a substantially vertical position transverse to the web;

a miniature airplane mounted above the web and facing the targets; and control means coupled to the airplane for moving the airplane laterally of the web across the width thereof and into the paths of the successively oncoming targets for knocking them down.

A further object of the invention is accomplished by control linkage of the control means for aligning the miniature airplane parallel to the path of movement of any target in any position thereof across the width of the web.

BRIEF DESCRIPTION OF THE DRAWINGS

In the detailed description of the invention presented below, reference is made to the accompanying drawings, in which:

FIG. 4 is an enlarged top plan view of the instrument panel of the toy airplane amusement game of FIG. 1;

FIG. 5 is a section view taken substantially along line 5—5 of FIG. 4;

FIG. 6 is a section view taken substantially along line 6—6 of FIG. 4;

FIG. 7 is a top plan view of the target envelope prior to assembly;

FIG. 8 is a front-elevational view of the L-shaped base of the target; and

FIG. 9 is a rear-elevational view of the assembled target.

DETAILED DESCRIPTION OF THE INVENTION

Figure 1:
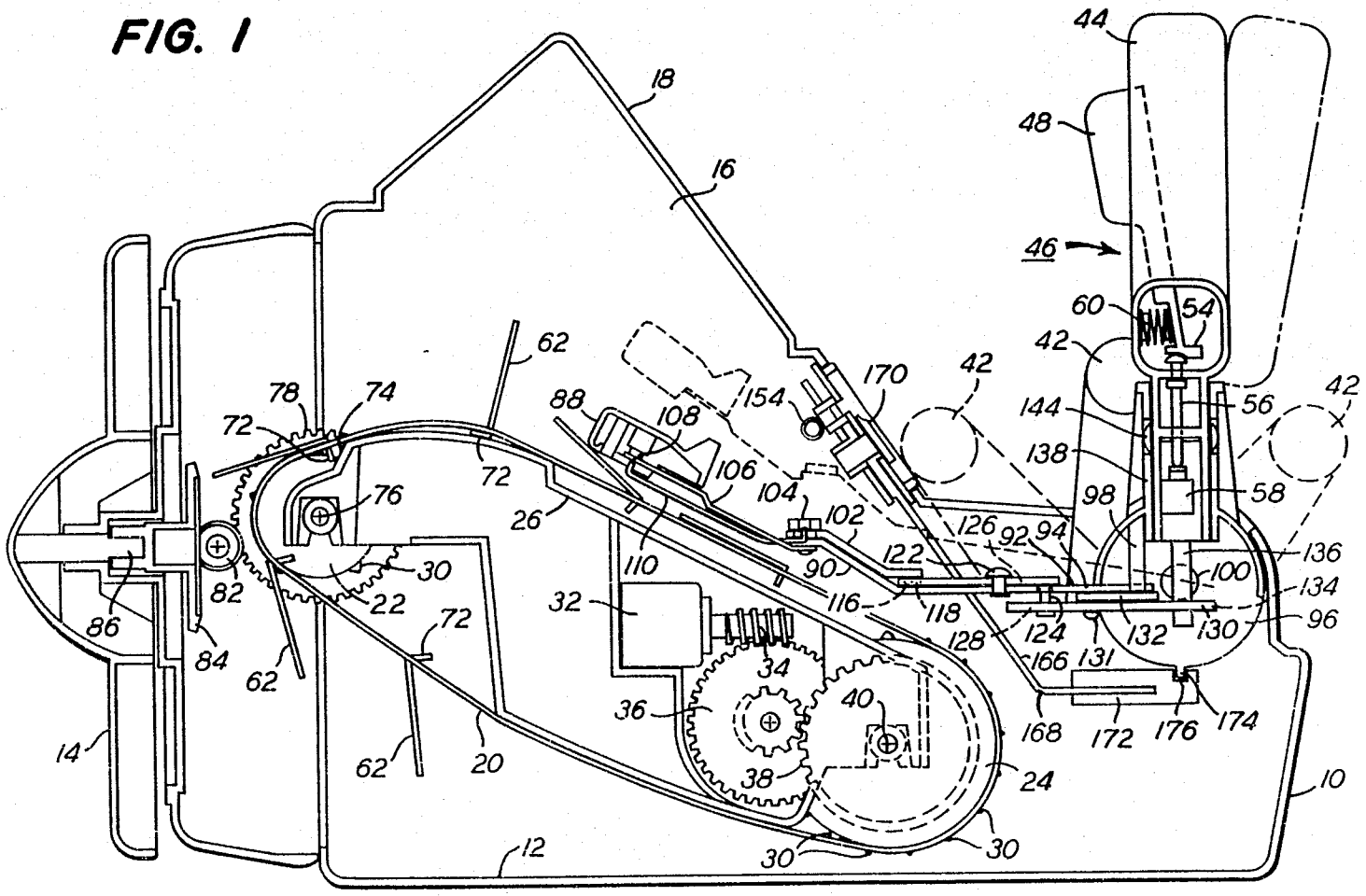
FIG. 1 is a side-elevational view, partially in section, of a preferred embodiment of a toy airplane amusement game of this invention.
Figure 2:
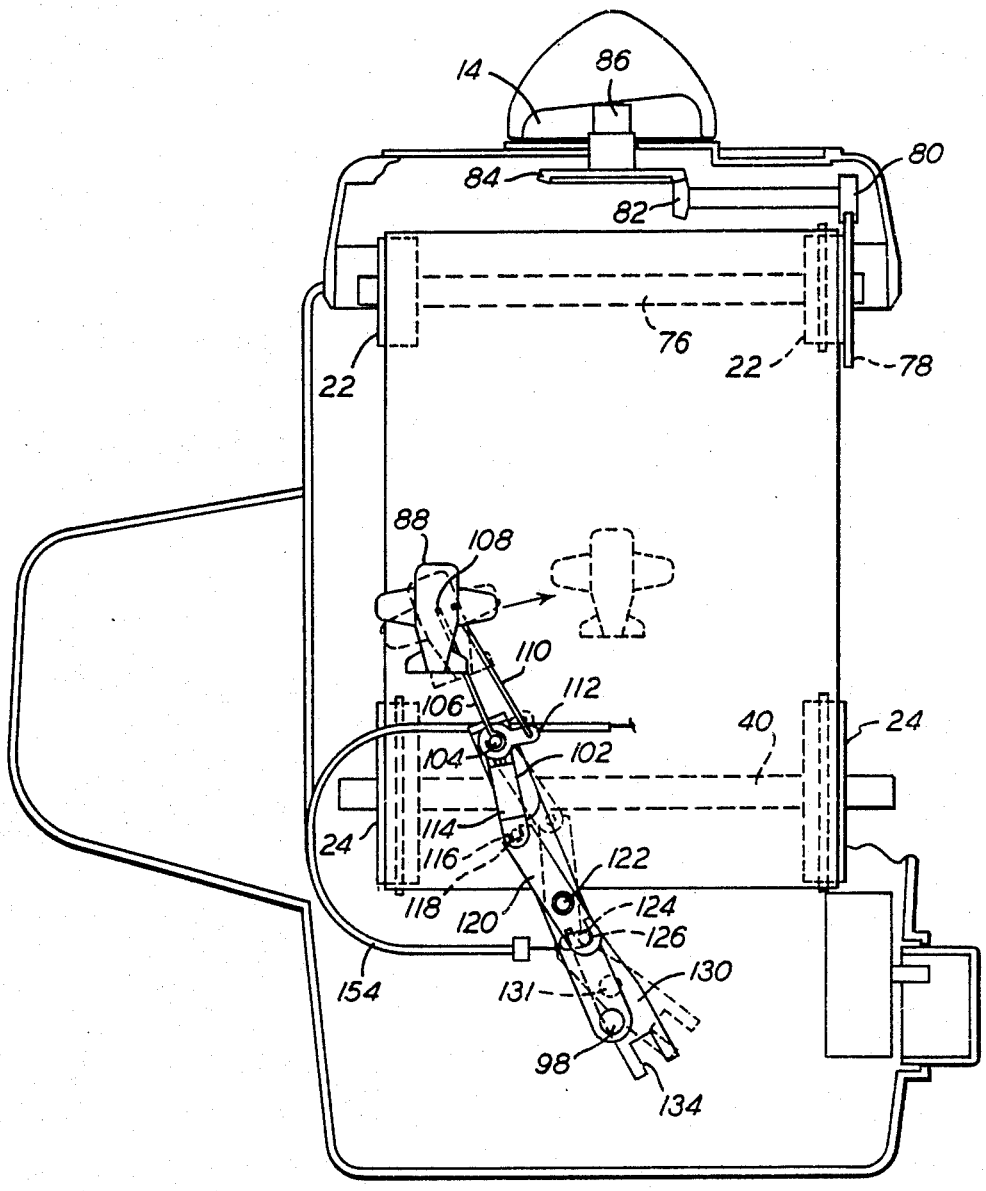
FIG. 2 is top plan view of the toy airplane amusement game of FIG. 1 with portions of the housing thereof omitted for purposes of clarity.

With reference to FIGS. 1 and 2, a preferred embodiment of the toy airplane amusement game of this invention comprises an outer housing 10 formed in the general shape of an airplane. The housing 10 has a base 12 adapted to rest on any suitable support surface, a rotatably mounted propeller 14 at the front end of the housing, a cockpit 16 covered by a transparent canopy 18, and a joystick control mechanism at the tail end of the housing.

Mounted within cockpit 16 of housing 10 is a transport mechanism for transporting a web in the form of an endless paper belt 20. The belt is trained over a pair of front wheels 22 and a pair of rear wheels 24 rotatably supported by an inner frame member 26 secured to housing 10. The belt 20 is provided with spaced perforations, not shown, along each side thereof, and is driven by sprocket teeth 30 on one or more of the wheels 22. 24 for engaging the perforations and driving the belt.

The rear wheels 24 are driven by an electric motor 32, which drives a pinion 34 in meshing engagement with a doublet gear 36 which in turn drives a large gear 38 mounted on a shaft 40 to which the rear wheels 24 are rigidly secured. The speed of electric motor 32 is controlled by a pivotally mounted speed control lever 42, which is movable between three positions for varying the resistance in the motor control electrical circuit by known means.

Figure 3:
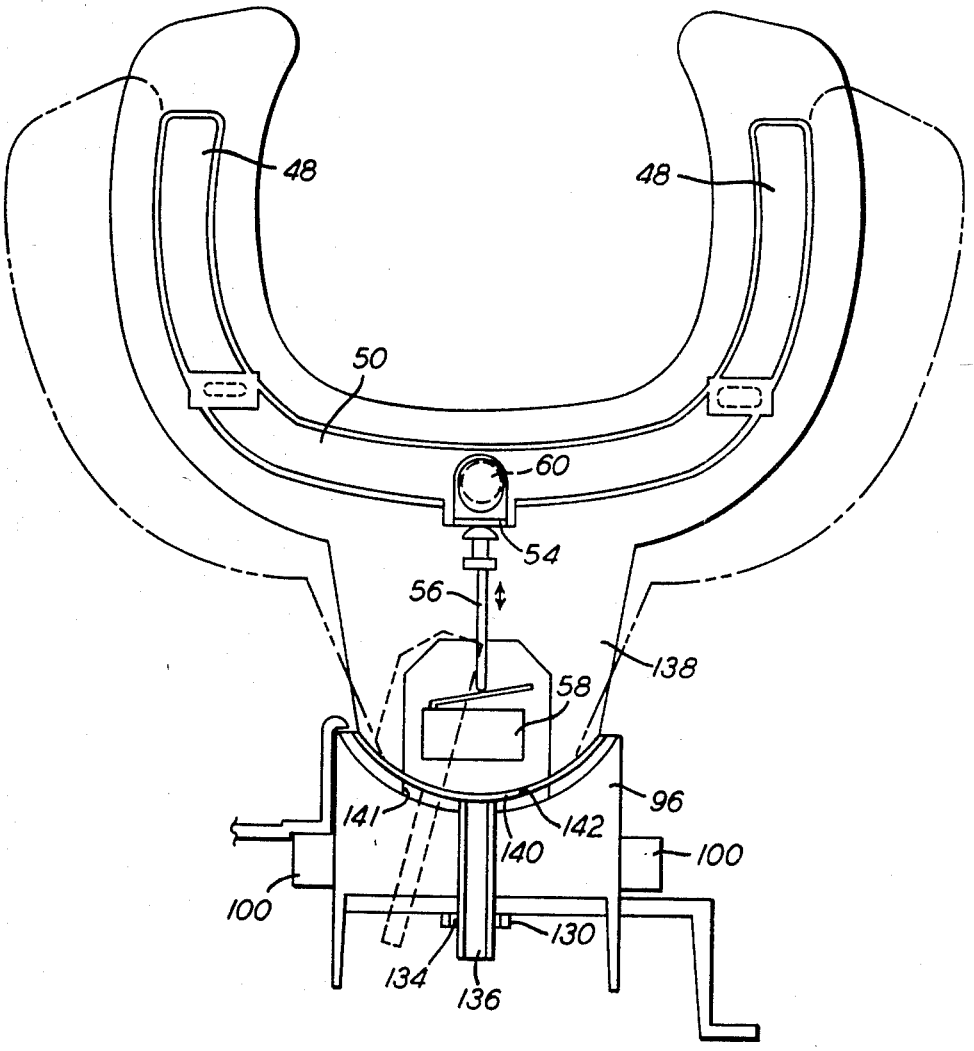
FIG. 3 is a front elevational view of the joy stick mechanism of FIG. 1 with portions of the mechanism omitted for purposes of clarity.

The switch mechanism for actuating electric motor 32 is mounted on forked handles 44 of a joystick 46, as best seen in FIGS. 1 and 3. The switch mechanism comprises buttons 48 on each handle 44 which are adapted, when depressed, to pivot a U-shaped lever about pivots 52. This causes a finger 54 at the end of lever 50 to depress a pin 56 which actuates a microswitch 58 electrically connecting motor 32 to a power source. When buttons 48 are released, a spring 60 returns the buttons to their normal position, allowing switch 58 to return to its normally open position.

The driven belt 20 transports a plurality of targets 62 that are preferably arranged on belt 20 in random laterally and longitudinally spaced positions. Each target 62, as best seen in FIGS. 5–7, comprises a rectangular piece of cardboard 64 or the like having an I-shaped slit 66 through which an L-shaped plastic insert 68 is inserted until the cardboard bottoms into notches 70 therein. An adhesive is applied to the top surface of cardboard 64 which is folded at slit 66 and clamped together to form a target 62, as seen in FIG. 7. A foot-piece 72 of each target, as best seen in FIG. 1, is inserted through a slit in belt 20 similar to slit 66. The foot-piece 72 on each target retains the target on the belt, and causes the target to flip-up into an upright position at the target entry end of the belt when the foot-piece 72 of each rides up a ramp 74 on frame 26.

In addition to transporting belt 20, the rotating front shaft 76 rigidly secured to front wheels 22 rotates a gear 78 secured thereto which drives a gear 80 coupled to a bevel gear 82. The bevel gear 82 drives a mating bevel gear 84 that is directly connected to propeller shaft 86 for driving propeller 14. Accordingly, when the amusement game is in operation and the belt 20 transported, front propeller 14 is rotated.

With reference to FIGS. 1–4, a miniature airplane 88 is shown along with control means for moving the airplane laterally across the width of belt 20 from one edge portion thereof to the other. The control means comprises a main lever 90 having one end 92 thereof extending through a slot 94 in a cylindrical member 96 at the base of joystick 46, and pivotally mounted on a post 98 depending from the cylindrical member. The member 96 is rotatably mounted in housing 10 on stub shafts 100. At the opposite end of lever 90, a linkage means is provided comprising an L-shaped lever 102 pivotally mounted thereto on pivot 104. A wire connector 106 connects pivot 104 to a center point 108 of airplane 88, and another wire 110 connects the end of lever leg 112 to a point on the airplane 88 offset from center point 108. The end of the other lever leg 114 has a depending pin 116 that fits into a blind slot 118 on another lever 120 secured to main lever 90 on pivot 122. The opposite end of lever 120 has a depending pin 124 that extends through an arcuate slot 126 in main lever 90, Pin 124 extends into a blind slot 128 at one end of still another lever 130 which is pivotally mounted on a pivot 131 of a support member 132 secured to cylindrical member 96. The opposite end of lever 130 has a square shaped blind slot 134 for receiving a depending post 136 from base 138 of joystick 46.

The base 138 of joystick 46 has an arcuately shaped surface 140 that is complementary to an arcuately shaped surface 142 of a peripheral groove in cylindrical member 96. The groove has an elongated opening 141 through which post 131 extends. The joystick 46 is pivotally mounted about a pivot 144 at a fixed radius from arcuate surface 140. Accordingly, the operator may pivotally move joystick 46 between the dotted positions shown in FIG. 3. Such pivotal movement of joystick 46 causes post 136 to move lever 130 laterally in one direction or the other, causing pin 124 to move in one direction or the other until it engages the end of arcuate slot 126 whereupon main lever 90 and airplane 88 supported thereby are moved laterally in one direction or other across the width of belt 20. The function of the linkage levers is to enable the operator to orient airplane 88 so that it is parallel to belt 20 and directly facing targets 62 in any position of the airplane across the width of the belt. For example, with reference to FIG. 2, in the dotted position of the linkage mechanism, the position of airplane 88 is shown when it reaches its outermost position along a left edge portion of belt 20. In this position, the joystick handles 44 are in the left-most dotted position, and post 136 and lever 130 are in the right-most position. To align the airplane parallel with the left edge portion of the belt, as seen in FIG. 2, joystick handles 44 are moved slightly to the right, causing the linkage levers to assume the full line position shown in FIG. 2, aligning airplane 88 so that it is parallel to the edge of the belt and in direct facing engagement with an oncoming target 62.

To move the linkage levers and airplane 88 from the left edge portion of the belt to the right edge portion of the belt, movement of joystick handles 44 to the right is continued. Such movement of the joystick is connected to a pair of gauges 146, 148 on a dashboard of the housing, as seen in FIG. 2 and 4, to partially rotate airplane wings 150 and a compass face 152 in a clockwise direction as joystick 46 is moved to the right as seen in FIG. 3. The wings 150 and compass face 152 are moved in a counter-clockwise direction when joystick 46 is moved to the left. The connection to gauges 146, 148 is achieved by a flexible cable 154 secured to housing 10 and a plane ascent and descent gauge 156, the cable 154 having a slidable wire 158, one end of which is connected to lever end portion 130 and its opposite end connected to a connector 160 on rotatable gear segment 162 on gauge 148. Accordingly, upon movement of joystick handles 44 to the left, as seen in FIG. 3, the lever end portion 130 moves to the left and arcuate gear segment 162 moves in a clockwise direction causing the meshing arcuate gear segment 164 to rotate in a counter-clockwise direction causing airplane wings 150 to bank in a counter-clockwise direction and compass face 152 to move clockwise. The reverse action occurs when joystick handles 44 are moved to the right.

By virtue of the connection of main lever 90 to the rotatable cylindrical member 96, movement of the joystick handles 44 of FIG. 1 from the full line position to the dotted position causes the main lever, linkage levers and airplane to move upwardly into the dotted position shown therein. At the same time, a plastic strap 166 having a living hinge 168 has one end of the strap connected to airplane wings 170 in ascent and descent gauge 156, and the opposite end of strap 166 secured to slider member 192 which is coupled to rotatable cylindrical member 96 by a finger 174 and slot 176 connection. Accordingly, as the joystick handles 44 are moved backwardly into the dotted position to raise airplane 88, strap 166 is moved upwardly causing airplane wings 170 in gauge 156 to move upwardly in slot 178 therein. Moving joystick 46 forwardly to its full line position in FIG. 1 causes strap 166 to move downwardly and airplane wings 170 to descend.

While a preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. A toy amusement game for knocking down flip-up targets comprising:

a housing, a pair of spaced rollers supported at each end of the housing, an endless web mounted on the rollers, drive means coupled to at least one of the rollers;

means for transporting laterally and longitudinally spaced targets in one direction on said web wherein each target in a horizontal position has a depending substantially vertical foot-piece, and the housing has an inclined ramp engagable by the foot-piece as it is transported on the web, the ramp camming the foot-piece and flipping the target into its substantially vertical position;

a miniature toy facing the targets; and control means coupled to the toy for moving the toy laterally of the web across the width thereof and into the paths of the successively oncoming targets for knocking them down.

2. A toy airplane amusement game according to claim 1 wherein the web has spaced perforations along the edges thereof, and the rollers have peripheral sprocket teeth for engaging the web perforations for transporting the web upon rotation of the rollers.

3. A toy airplane amusement game according to claim 1 wherein the control means comprises a substantially vertically positioned joystick having a handle at one end and the opposite end coupled to the airplane for forward and reverse movement in the one direction, and side-by-side motion laterally of the web.

4. A toy airplane amusement game according to claim 3 wherein a cylindrical member is rotatably mounted on the airplane, and has an arcuate slot having a central opening extending through the member, and the joystick is pivotally mounted on the airplane on a pivot between its one end and opposite end, and the opposite end of the joystick has an arcuate portion slidably mounted within the arcuate slot for side-by-side movement upon side-by-side movement of the handle of the joystick, the opposite end further having a post depending from the arcuate portion and extending through the central opening.

5. A toy airplane amusement game according to claim 4 wherein the control means comprises linkage means connecting the depending post to the airplane whereby lateral movement of the post in one direction laterally moves the plane in the opposite direction.

6. A toy airplane game according to claim 5 wherein the linkage means comprises a main lever having one end pivotally connected to the cylindrical member, an L-shaped lever pivotally connected on a first pivot to the opposite end of the main lever, a first wire connected from the first pivot to the center of the airplane, a second wire connected from one end of the L-shaped lever to a position on the airplane offset from the center thereof, a first connector lever having a midportion pivotally connected to the main lever, the first lever having one end pivotally connected to the opposite end of the L-shaped lever, and the opposite end of the first lever having a depending pin extending through an arcuate slot in the main lever, and a second connector lever having a midportion pivotally connected to the cylindrical member, the second lever having one forked end for receiving the depending pin and an opposite forked end for receiving the depending post.

7. A toy airplane game according to claim 6, and further comprising a wings banking gauge and a simulated compass interconnected by meshing gears, and means coupling the one forked end of the second lever to one of the meshing gears whereby movement of the joystick in one direction causes the wings to bank in that one direction and the compass to move in the opposite direction.

8. A toy airplane game according to claim 7, and further comprising a plane ascent and descent gauge having a plane that is movable up and down, and means coupling the cylindrical member to the plane whereby movement of the joystick in a forward direction causes the plane in the gauge to descend and movement of the joystick in a rearward direction causes the plane in the gauge to ascend.

* * * * *